United States Patent [19]

McLean

[11] Patent Number: 5,065,969

[45] Date of Patent: Nov. 19, 1991

[54] APPARATUS FOR MOUNTING AN ANTENNA FOR ROTATION ON A MAST

[75] Inventor: John A. B. McLean, Fergus, Canada

[73] Assignee: Bea-Bar Enterprises Ltd., Fergus, Canada

[21] Appl. No.: 349,484

[22] Filed: Jun. 9, 1989

[51] Int. Cl.[5] ..... E04G 3/00

[52] U.S. Cl. ..... 248/282; 248/522; 343/758; 343/763; 343/766

[58] Field of Search ..... 248/282, 283, 514, 521, 248/522; 74/98, 86, 421 R, 421 A; 343/766, 763, 757, 758, 882

[56] References Cited

U.S. PATENT DOCUMENTS

| | | | |
|---|---|---|---|
| 2,540,696 | 2/1951 | Smith, Jr. | 343/766 |
| 2,578,151 | 12/1951 | Ronfeldt | 343/763 |
| 2,794,162 | 5/1957 | Lifsey | 343/766 X |
| 2,931,035 | 3/1960 | Reinhard et al. | 343/766 |
| 2,966,811 | 1/1961 | Sundt | 343/882 X |
| 3,146,452 | 8/1964 | Rose | 343/758 |
| 3,521,384 | 7/1970 | Holland | 74/86 X |
| 3,821,744 | 6/1974 | Briley | 343/763 |
| 3,952,984 | 4/1976 | Dimitry | 248/282 |
| 4,691,207 | 9/1987 | Timineri | 343/766 |
| 4,814,781 | 3/1989 | DeHaven | 343/766 |
| 4,866,456 | 9/1989 | Ebey | 343/766 |

FOREIGN PATENT DOCUMENTS

| | | | |
|---|---|---|---|
| 301056 | 11/1916 | Fed. Rep. of Germany | 248/522 |

*Primary Examiner*—Carl D. Friedman
*Assistant Examiner*—Daniel Hulseberg
*Attorney, Agent, or Firm*—Anthony Asquith & Co.

[57] ABSTRACT

The device includes a fixed component (30) which is in two half-shells which clamp, sideways-on, around the fixed mast (3), and a rotatable component (28) which also is in two half-shells which, when assembled around the mast, are guided for rotation relative to the mast. Several rotation apparatuses (one per antenna) may be attached at different points on the height of the mast, so that each antenna (19) may be orientated independently of the other antennas towards the appropriate TV transmitting station. The stub shaft (29) on which the antenna (19) is carried may be rotatable relative to the housing (28), and so geared that a 180 deg rotation of the housing produces a 360 deg rotation of the shaft and antenna.

11 Claims, 5 Drawing Sheets

APPARATUS FOR MOUNTING AN ANTENNA FOR ROTATION ON A MAST

The invention relates to a rotary mounting apparatus for the kinds of mast and antenna that are used in the reception of TV signals and the like.

The invention may be applied to antenna mountings in which, for the best signal reception, the antenna has to be rotated until the antenna is geographically aligned with the transmitting station. Such antennas are used for example on ships, and by ham radio operators, and for FM radio reception, but the most common use is for the domestic reception of TV signals, and the invention will be described hereinafter as it relates to that usage.

In the rotation apparatuses to which the invention relates, the movement of the antenna takes place only occasionally, and for a short period of time; this should be contrasted with, say, a radar scanner, in which the antenna is constantly moving. The different requirements, particularly of the bearings, make mountings for constantly-scanning radar antennas quite different from mountings for household TV antennas.

BACKGROUND TO THE INVENTION

For the best quality of reception of TV signals it is necessary to align the antenna with the TV transmitting station, and it is the usual rule in the design and construction of the masts upon which the antenna is to be mounted that some provision be made for the antenna to be rotated into alignment with the transmitting station.

Generally, it is required that the antenna should be set, in the rotational sense, individually for each transmitting station or source. Thus, it may be necessary, depending on local conditions, to reset the antenna every time a channel is changed. It is conventional for the TV viewer therefore to provide himself with a means for controlling the rotational setting of the antenna. The means may include an armchair control for an electric motor housed upon the mast, which, when energised, rotates the antenna.

In the conventional apparatus for rotating the antenna, a housing is clamped to the exposed top end of the fixed mast. The housing contains bearings for guiding and supporting a separate shaft upon which the antenna is affixed with U-bolts. The electric motor is contained within the housing, and acts to rotate the separate shaft when energised.

One of the main limitations with this conventional type of apparatus is that it is inconvenient to include independently rotatable antennas on the same mast. The problem is that any and every antenna attached to the separate shaft will rotate in unison when the shaft rotates. If, therefore, a household possesses two or three TV sets, and if each TV set were to have its own respective antenna attached to the said separate shaft, then, when the individual occupants are watching different channels (from different transmitters) only one of those two or three antennas would be aligned correctly with its transmitter at any one time.

Previously, the conventional way around this problem has been to provide two or three separate masts, which is very expensive. If the household possesses two TV sets, each with its own antenna, the problem will inevitably arise: because the reason for having two sets almost always is that different members of the household may thereby watch different channels. If one of the antennas on the mast is a TV antenna and the other is an FM radio antenna mounted on the same mast, even then the problem of different members of the household wanting to watch or listen to different programs will arise.

DESCRIPTION OF THE GENERAL FEATURES OF THE INVENTION

In the invention, the apparatus for rotating the antenna relative to the mast is arranged in such a manner that the apparatus can be assembled radially or laterally onto the fixed mast. In the invention, a non-rotatable component is in two portions which are brought together around the mast, and which are thereby clamped to the mast or otherwise secured against rotation relative to the mast.

In the broadest aspect of the invention, the rotatable component is guided and mounted in the non-rotatable component for rotation around the mast. In the invention, the axis of rotation of the rotatable component is vertical, and the axis of rotation lies inside the cross-sectional outline of the mast.

By virtue of this arrangement, the apparatus can be set up so that the antenna can sweep through a full 360 degrees of angular movement around the mast, without interfering with the mast. In the conventional apparatus, the mast could sweep 360 degrees, but only because the apparatus was situated above the top end of the mast.

Proposals have been made for attaching a rotation apparatus at an intermediate point along the height of one of the legs of a mast, as for example in U.S. Pat. No. 3,952,984 (DIMITRY, Apr. 76). In the invention, however, the mast itself doubles as the mounting shaft for the rotation apparatus, around which rotates the rotatable component, which means that no other mounting shaft need be provided for that purpose.

It may be noted that when the mounting shaft, ie the shaft around which rotates the rotatable component, is offset from the mast, as in DIMITRY, a problem arises in that, if any elements of the array were to lie close to the mounting shaft, those elements would interfere with the mast towards the extremes of the 360 degree travel. Therefore, the designer must pay the penalty of having to leave a space, clear of elements, in the middle of his array if his axis of rotation does not lie coaxially with, or at least lie inside, the mast. The greater the offset, the greater the clear space that must be left. In the invention, there is no such restriction to the positioning of the elements.

Thus, it is not only a mark of economy to eliminate the requirement for the extra mounting shaft, but also a restriction on the permissible layout of the elements is thereby removed.

The apparatus of the invention is comparable in economy to the conventional apparatus which has to protrude above the top of the mast in order to have clearance for a full 360 degree sweep. The conventional apparatus is economical because it uses the mast itself as the mounting means for the apparatus. The invention retains this advantage and, at the same time, the invention also permits the apparatus to be mounted at an intermediate point along the height of the mast.

In the descriptions which follow of the embodiments, it will be noted that the rotatable component need not necessarily be itself in separable portions, for assembly in situ onto the mast: the essential aspect is that the rotatable component be guided and supported for rotation around the mast. Nevertheless, even though not essential, it will be seen from the embodiments that it becomes much simpler from many standpoints if the rotatable component can also be in two separable portions, for assembly sideways-on around the mast, like the non-rotatable component.

Thus, in a preferred form of the invention, the rotatable component is also in two portions which are brought together around the mast, and which are thereby guided for rotation relative to the mast.

With the invention, since the apparatus can be attached at any intermediate point along the height of the mast, without access to the ends of the mast, more than one of the apparatuses may be attached to the mast, at different points along the height of the mast. Each apparatus then may carry one antenna, and the rotational orientation of each may be independently controlled through respective armchair controllers provided one for each apparatus.

Another advantage that arises from the use of the apparatus of the invention is that it is a simple matter to arrange for the servicing of any one of the apparatuses, of the antennas which are attached thereto. All that is necessary is to uncouple the individual apparatus and lift it down from the mast, without necessarily removing the others. In some cases, with the invention, it might be an advantage to slide other apparatuses along the height of the mast, when taking a particular apparatus down for servicing, but that is generally easy to accomplish.

An advantage relating to the robustness of the bearings arises with the invention, which may be explained as follows. In the conventional apparatus, wherein the apparatus for rotating the separate shaft is mounted over the end of the fixed mast, the separate shaft has to be elongate in order to carry all the antennas (if more than one antenna is provided); as a result, the bearings contained within the conventional apparatus may, when more than one antenna is present, have to accommodate a large bending moment. With the invention, the antenna may be coupled to a short stub shaft at a point very close to the apparatus, so that the forces on the antenna are fed into the fixed mast without the bearings in the apparatus being subject to an undue stress.

Thus, where more than one antenna (and more than one rotation apparatus) is provided, in the invention, each has its own bearings, and the design limitation lies more in the static strength of the mast, rather than in the wear limits of the bearings. Therefore, the bearings within the apparatus need not be overdesigned, as they had to be in the prior art versions.

In another form of the invention, the stub shaft upon which the antenna is mounted may be itself rotatable relative to the rotatable component, for added versatility of accommodating the full 360 degree arcuate sweep.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by features of specific embodiments.

Figure 1:
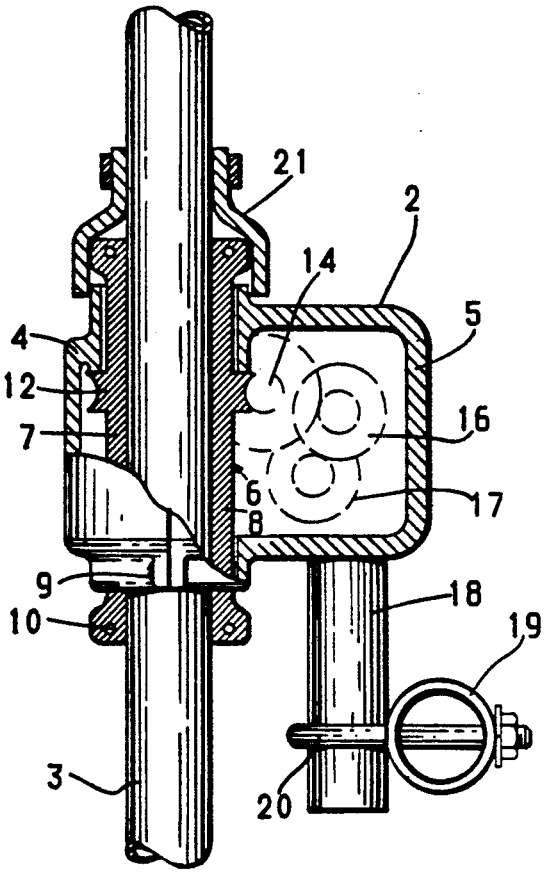
FIG. 1 is cross-sectional elevation of an apparatus which embodies the invention.

The apparatus shown in FIG. 1 includes a housing 2, which is mounted for rotation about a mast 3. The housing 2 is in two portions 4,5 which are separable so as to allow the housing 2 to be assembled radially, ie laterally, onto the mast 3.

The apparatus includes also a sleeve 6, which, like the housing 2, is in two separable portions 7,8.

The two portions 4,5 of the housing 2 are held together around the mast 3 by means of screws 9. Similarly, the two portions 7,8 of the sleeve 6 are held together by means of screws 10. The person installing the apparatus can assemble and screw together the portions 4,5, and the portions 7,8, without needing to have access to the end of the mast 3.

The dimensions of the sleeve 6 are such that when the two portions 7,8 are screwed together around the mast 3, the sleeve 6 is clamped to the mast 3, and is locked firmly both against rotational movement around the mast, and against movement along the axis of the mast.

The dimensions of the housing 2 are such that when the two portions 4,5 are screwed together around the mast 3, and around the sleeve 6, the housing 2 can rotate around the sleeve 6. The sleeve 6 includes a gear 12, which is of greater diameter than the main length of the sleeve. The housing 2 is so shaped, as shown, as to rest on the gear 12, and the housing 2 is thereby in rubbing bearing engagement with the gear 12 during rotation of the housing.

In mesh with the gear 12 is a worm 14, which is mounted in the housing 2, and which is driven through a gear train 16 by an electric motor 17. When the motor 17 is energised, the housing 2 is caused to rotate around the fixed gear 12, and therefore around the mast 3.

A weather guard or cover 21 is sealed and clamped to the mast 3, and acts to protect the moving components and bearings inside the housing from the elements.

The housing 2 is provided with a stub shaft 18, to which an antenna 19 may be attached by means of the usual U-bolts 20. The electrical leads (not shown) from the antenna are provided with enough slack and so disposed as to accommodate the 360 degree movement, as are the leads to the motor 17.

Any other leads, such as those required for an antenna amplifier, if fitted, also must be arranged to accommodate the rotary movement of the housing.

In an alternative version (not shown) of the FIG. 1 embodiment, the housing may be of considerably larger size and shape, whereby the antenna elements can be accommodated actually within the housing. The resulting structure in this case is neat in appearance, and is well protected against the elements. If electronic components (eg a signal amplifier) are to be included in the apparatus, these may be readily accommodated inside such a housing. Depending on the configuration requirements of the antenna elements, in some cases only the shorter elements of an array would be placed inside the housing, the rest being attached outside the housing. The housing may be formed as a plastic moulding.

In another variation (not shown) of the FIG. 1 embodiment, the antenna may be screwed directly into the housing, utilising a threaded socket cut for that purpose in the material of the housing. In some cases, such an arrangement would be preferred over that of attaching the antenna with U-bolts to the stub 18, as illustrated.

Figure 2:
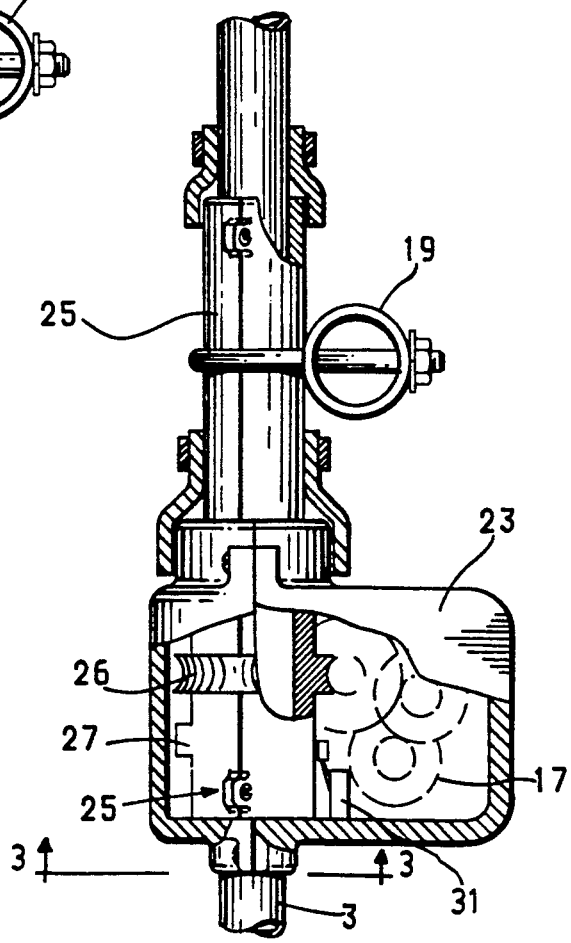
FIG. 2 is cross-sectional elevation of another apparatus which embodies the invention.
Figure 3:
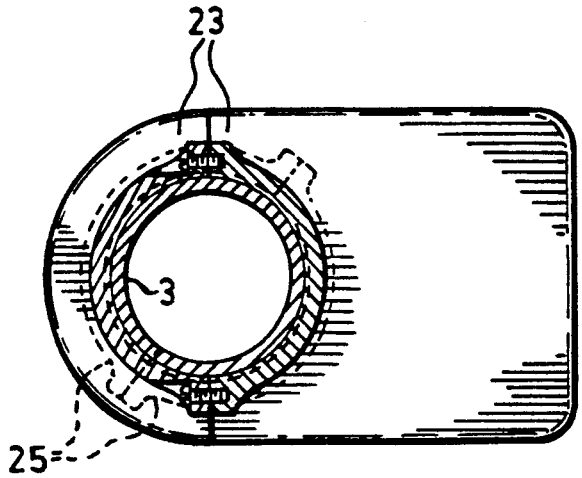
FIG. 3 is a diagrammatic view on arrows 3—3 in FIG. 2.

In the embodiment shown in FIGS. 2 and 3, the housing 23 is itself clamped to the mast 3, and does not rotate. The sleeve 25 is dimensioned for rotation around the mast 3, and for rotation within the housing 23. The gear 26 on the sleeve 25 now rotates, to drive the sleeve, when the motor 17 is energised, while the motor itself remains stationary, with the housing 23.

As shown in FIG. 2, the bearing through which the weight of the rotating component is supported need not be the gear, as was the case in FIG. 1: in FIG. 2, the bottom of the sleeve 25 rotates against the housing 23.

The sleeve 25 is provided with a tab 27, which acts as a cam to activate a micro switch 31. The micro switch 31 is set up so as to disable the motor 17 from rotating the housing 2 beyond a permitted arc of 360 degrees relative to the mast.

Figure 4:
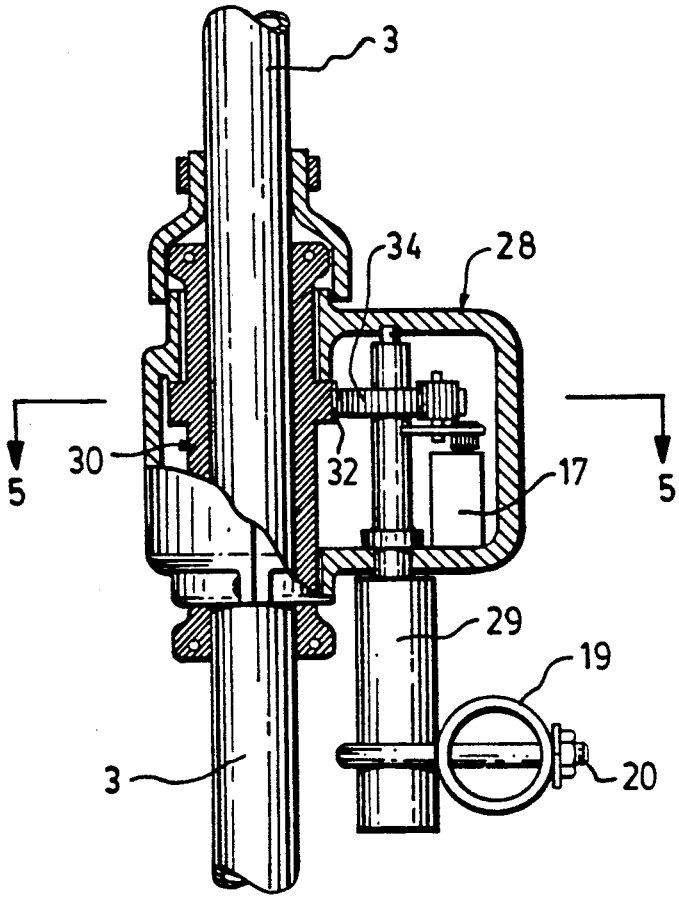
FIG. 4 is cross-sectional elevation of yet another apparatus which embodies the invention.
Figure 5:
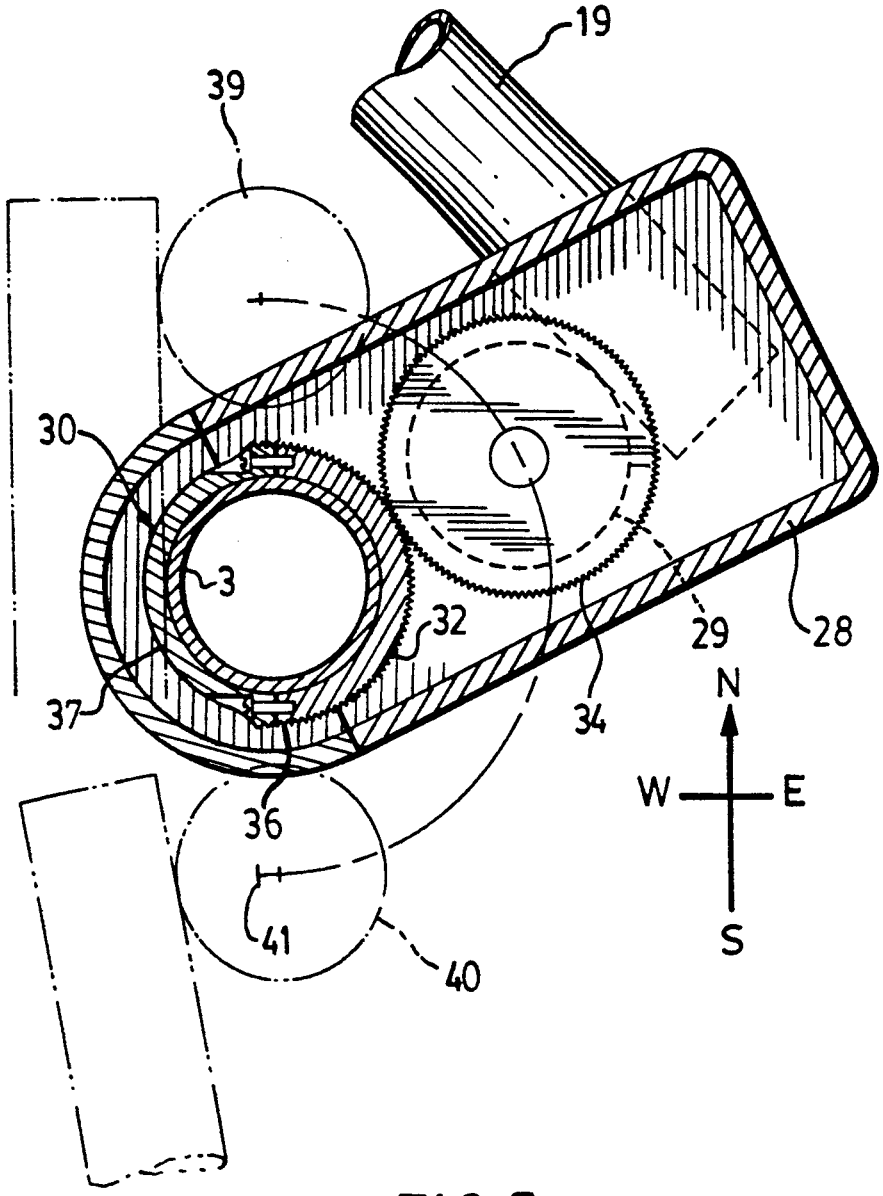
FIG. 5 is a diagrammatic plan view on arrows 5—5 in FIG. 4.

In the embodiment of FIGS. 4 and 5, the housing 28 rotates around the mast 3, as was the case also in the FIG. 1 design, but in FIG. 4 the stub shaft 29 also rotates.

The sleeve 30 is in two portions which, when screwed together, are clamped to the mast 3. Again, the sleeve 30 incorporates a gear 32. In mesh with the gear 32 is another gear 34, which is carried on the stub shaft 29. The assembly comprising the stub shaft 29 and the gear 34 is mounted for rotation relative to the housing 28.

When the motor 17 is energised, the stub shaft 29 is driven bodily, with the housing 28, around the mast 3, and at the same time the stub shaft 29 rotates within the housing 28. The result is that as the housing sweeps through a given arc, the stub shaft rotates through double that arc. This ratio is a function of the pitch diameter of the two gears 32,34 being the same: other ratios of arcuate movement could be achieved by utilising other pitch diameters.

It follows that, in FIG. 4, in order to provide the full 360 degrees required for the rotation of the antenna stub shaft 29, the housing 28 itself need only rotate through 180 degrees. This is an advantage in that the gear 32 need only extend over one of the portions of the sleeve 30, and also in that the wiring to the housing is easier to arrange.

In the plan view of FIG. 5, the sleeve 30 is clamped to the mast 3 such that the joint line 36 between the gear 32 and its clamping piece 37 lies in the North-South orientation. When the housing 28 is oriented to lie East-West, the antenna 19 is set to lie North-South.

As shown in FIG. 5, the housing 28 has been rotated anti-clockwise about 22 degrees from East-West, and the antenna 19 consequently has rotated 44 degrees anti-clockwise from North-South.

As shown in dotted lines at 39, the antenna 19 has rotated anti-clockwise as far as it will go, and now lies South-North. The clockwise orientation is shown at 40, where the antenna 19 lies (almost) at South-North. The actual limit of clockwise travel is shown at 41, the limits 39,41 being controlled by tabs and microswitches similar to those shown in FIG. 2.

Figure 6:
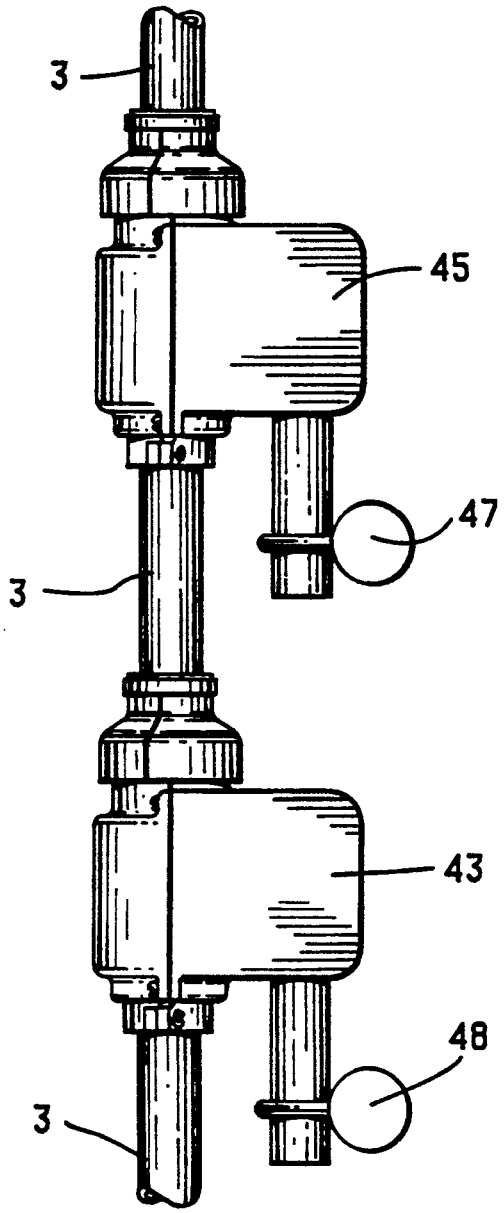
FIG. 6 is a side elevation of an antenna mast on which are mounted two of the apparatuses of FIG. 4.

FIG. 6 shows the mast 3 with many rotation apparatuses 43,45, and their associated antennas 47,49 attached thereto. The various electrical leads may be fed through holes drilled through the fixed mast 3, and may pass internally down the mast. Usually, however, it is preferred not to drill holes in the mast, but to keep the work that has to be carried out aloft to an absolute minimum. In the preferred embodiments of the invention, no drilling of the mast is required. The wires may be taped or clipped to the outside of the mast, suitable allowance being made for the wires to pass down without interfering with the apparatuses below.

The rotation apparatus should preferably be sealed against the elements, and the weather-guard seal 21 (FIG. 1) is provided for that purpose. In keeping with the rest of the invention, the seal 21 should be assembleable radially or laterally with respect to the mast. The seal may be slit at a point on its circumference, to enable the seal to be wrapped around the mast; a suitable clamp then serves to close the gap left by the slit.

The electric motor, gears, and other moving parts, should all be contained within the housing for weather protection, as shown in the embodiments.

Figure 7:
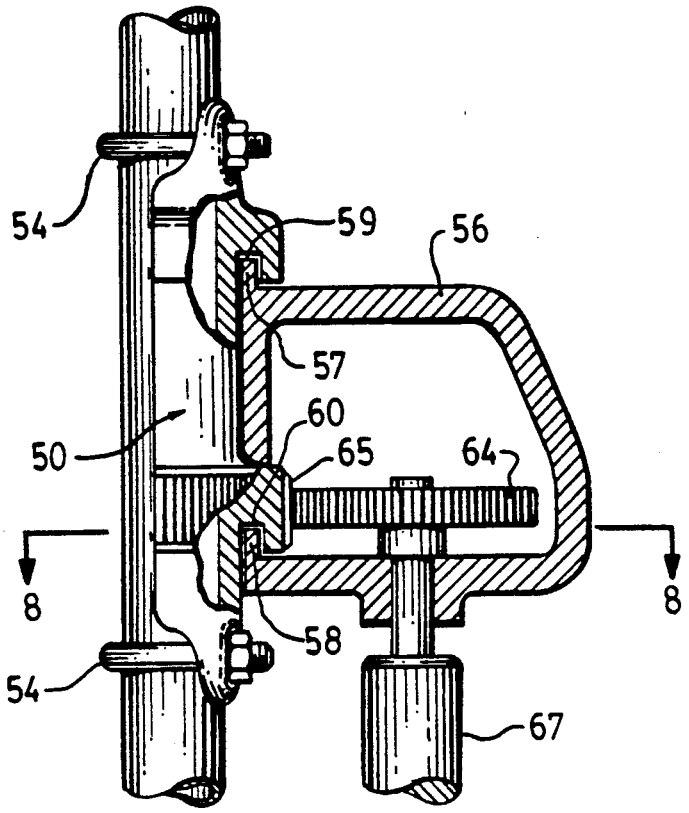
FIG. 7 is a cross-sectional view of still another apparatus which embodies the invention.
Figure 8:
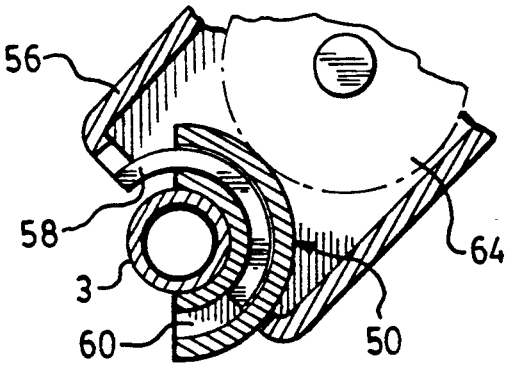
FIG. 8 is a diagrammatic plan view on arrows 8—8 in FIG. 7.

In the further embodiment shown in FIGS. 7 and 8, only the non-rotatable component is in separable portions, i.e. in portions that can are assembled together sideways-on around the mast, without acces to the end of the mast.

The non-rotatable component comprises a body 50, and two U-bolts 54. The body 50 is assembled sideways-on to the mast 3, and secured in place by means of the U-bolts. The rotatable component in this case comprises a housing 56. The housing 56 has upper and lower toungues 57,58 which engage with complimentary upper and lower grooves 59,60 formed in the non-rotatable body 50.

The body 50 is generally semi-cylindrical in shape, and, as will be appreciated from the drawings, the grooves 59,60 extend only half-way around the mast. Similarly, the toungues 57,58 on the rotatable housing 56 are semi-circular.

As a consequence of the semi-circular character of the toungues and grooves, it is possible to assemble the housing 56 to the body 50 sideways-on; in FIG. 8, it will be noted that if the housing 56 were to be rotated anti-clockwise through 135 degrees from the position shown, the toungue 58 would move clear of the groove 60, and the housing 56 could then be detached from the body 50. The housing can be assembled to the body in a corresponding manner. The housing 56 may be fitted to the body 50 either before the body 50 is attached to the mast 3, or after.

The housing 56 is fitted with a gear 64, which engages a corresponding half-gear 65 formed on the body 50. As in the earlier embodiments, a motor is provided for driving the gear 64. The gear 64 is connected to a stub shaft 67, to which the antenna may be attached. The arrangement of FIGS. 7,8 is similar to that of FIGS. 4,5 in that a full 360 degrees of rotation of the stub-shaft 67 is achieved in only 180 degrees of rotation of the housing 56.

As shown in FIG. 7, the toungues on the housing occupy no more than a half-circle; although in practice, some extension of the dimensions of the toungues beyond the half-circle can be accommodated, the arc of travel of the toungues substantially cannot exceed 180 degrees. Therefore, if the full 360 degrees of rotation is to be provided for the antenna, it is in fact a necessary requirement that the stub shaft 67 should itself rotate, and preferably in the FIG. 5 manner.

The engagement of the tongues 57,58 with the grooves 59,60 is such that the housing 56 is constrained against all modes of movement relative to the mast 50, other than rotation around the mast.

The embodiment of FIGS. 7 and 8 is in fact more difficult to seal against the elements than the previous embodiments, and is less preferred for that reason. However, if suitable materials are used, and in suitable climates, the apparatus of FIGS. 7,8 can give good service, and it does have the advantage that assembly of the whole apparatus to the mast can be achieved by means simply of the two U-bolts.

It may be noted that the "non-rotatable" component required in the invention comprises, in the FIGS. 7,8 embodiment, the sub-assembly of the housing 56 and the U-bolts 54: thus, in this case the U-bolts 54 comprise one of the "separable portions", while the housing 56 comprises the other.

An advantage that arises from the arrangement of the body 50, with the U-bolts 54, is that the body may be clamped firmly and tightly to the mast even if the mast is of a different diameter from the nominal diameter of the body. In the embodiment of FIG. 1, for example, where the sleeve completely encircles the mast, it would be more difficult to accommodate different mast diameters.

In the FIGS. 7,8 embodiment, because the gear 64 is assembled sideways-on, the gear cannot extend all the way round the mast. Therefore, if a full 360 degrees of arcuate movement is required for the antenna, the antenna cannot be fixed relative to the rotatable housing 56 in the manner of FIG. 1; instead the antenna must be mounted on a stub shaft which is geared for rotation relative to the housing in the manner of FIG. 5.

I claim:

1. Apparatus for mounting an antenna on a vertical mast for rotation of the antenna around the mast, wherein:

the apparatus includes a rotatable component and a non-rotatable component, and a means for supporting and guiding the rotatable component for rotation relative to the non-rotatable component;

the rotatable component includes a means for attaching the antenna thereto;

the non-rotatable component includes a means for clamping and locking the non-rotatable component around, and to, the mast;

the rotatable component and the non-rotatable component are each so constructed and arranged that each may be assembled to the mast radially with respect to the mast, at an intermediate point along the length of the mast, away from, and without access to, the ends of the mast;

the apparatus includes a gear wheel, and another gear which is in operative meshing engagement with the gear wheel;

the gear wheel and the said other gear are operatively associated one with the rotatable component, and the other with the non-rotatable component;

the apparatus includes an operable drive means which is effective, when operated, to drive the gear wheel and the other gear in relative rotation, and thereby to rotate the rotatable component;

the gear wheel has gear teeth which are arranged in a circular arc, and the arrangement of the apparatus is such that, when the apparatus is assembled to the mast, the axis of the said arc is vertical and lies within the cross-section of the mast;

the gear wheel is in two separable portions, which are so adapted and arranged that the portions may be assembled to the mast radially with respect to the mast, and may be joined together around the mast, at an intermediate point along the length of the mast, away from, and without access to, the ends of the mast;

the non-rotatable component is in two separable portions, which are so adapted and arranged that the portions may be assembled to the mast radially with respect to the mast, and may be joined together around the mast, at an intermediate point along the length of the mast, away from, and without access to, the ends of the mast;

and the rotatable component is in two separable portions, which are so adapted and arranged that the portions may be assembled to the mast radially with respect to the mast, and may be joined together around the mast, at an intermediate point along the length of the mast, away from, and without access to, the ends of the mast.

2. Apparatus of claim 1, wherein the means for attaching the antenna to the apparatus includes a stub shaft mounted in the apparatus.

3. Apparatus of claim 2, wherein the rotatable component includes a housing, and the stub shaft is fixed in relation to, and is not rotatable relative to, the housing.

4. Apparatus of claim 2, wherein the stub shaft is concentric with the mast.

5. Apparatus of claim 1, wherein the gear wheel is non-rotatable, and is operatively associated with the non-rotatable component.

6. Apparatus of claim 5, wherein:

the means for attaching the antenna to the apparatus includes a stub shaft mounted in the apparatus;

the stub shaft is mounted in bearings within, and for rotation relative to, the housing;

and the stub shaft is coupled to the rotatable other gear.

7. Apparatus of claim 6, wherein the gearing ratio between the rotatable other gear and the non-rotatable gear wheel is such that when the housing rotates 180 degrees around the mast, the stub shaft rotates substantially 360 degrees.

8. Apparatus of claim 1, wherein the gear wheel is rotatable and is operatively associated with the rotatable component.

9. Apparatus of claim 1, wherein the circumferential length of the said arc is a complete circle.

10. Apparatus of claim 1, wherein the circumferential length of the said arc is substantially less than a complete circle.

11. Apparatus of claim 1, wherein:

the apparatus includes a means for supporting and guiding the rotatable component upon the non-rotatable component, which comprises a tongue formed on one of the components and a complimentary groove formed on the other of the components;

and both the components, including the tongue and the groove thereof, include arcuate gaps of sufficient circumferential length that both components can be assembled radially to the mast.

* * * * *